US008138946B2

(12) United States Patent
Villalobos et al.

(10) Patent No.: US 8,138,946 B2
(45) Date of Patent: Mar. 20, 2012

(54) SYSTEM AND METHOD FOR NOTIFICATION OF PRESENCE OF EMERGENCY VEHICLES

(76) Inventors: Eduardo Villalobos, Pasadena, CA (US); Ramon Villalobos, Pasadena, CA (US)

( * ) Notice: Subject to any disclaimer, the term of this patent is extended or adjusted under 35 U.S.C. 154(b) by 360 days.

(21) Appl. No.: 12/393,442

(22) Filed: Feb. 26, 2009

(65) Prior Publication Data

US 2009/0243879 A1 Oct. 1, 2009

Related U.S. Application Data

(60) Provisional application No. 61/072,013, filed on Mar. 27, 2008.

(51) Int. Cl.
*G08G 1/00* (2006.01)

(52) U.S. Cl. ..... 340/902; 340/904; 340/692; 340/384.4

(58) Field of Classification Search ..... 340/901–905, 340/936, 692, 384.4, 988, 989, 943, 693.3; 701/213, 301, 302

See application file for complete search history.

(56) References Cited

U.S. PATENT DOCUMENTS

| | | | | |
|---|---|---|---|---|
| 3,876,940 | A * | 4/1975 | Wickord et al. | 455/341 |
| 4,247,955 | A | 1/1981 | Wiedemann | |
| 4,359,713 | A | 11/1982 | Tsunoda | |
| 4,952,931 | A * | 8/1990 | Serageldin et al. | 340/902 |
| 5,287,411 | A * | 2/1994 | Hill et al. | 704/231 |
| 5,495,242 | A * | 2/1996 | Kick et al. | 340/902 |
| 5,894,279 | A * | 4/1999 | Rose et al. | 340/902 |
| 6,690,291 | B1 * | 2/2004 | Cardillo et al. | 340/901 |
| 7,016,509 | B1 | 3/2006 | Bharitkar et al. | |
| 7,061,402 | B1 * | 6/2006 | Lawson | 340/988 |
| 7,791,499 | B2 * | 9/2010 | Mohan et al. | 340/902 |
| 2002/0102961 | A1 * | 8/2002 | Gibbons et al. | 455/404 |

* cited by examiner

*Primary Examiner* — Anh V La
(74) *Attorney, Agent, or Firm* — Steinfl & Bruno, LLP

(57) ABSTRACT

Systems and methods for notification of presence of emergency vehicles are described. The system includes an acoustic receiver to be mounted on a car, and a detection circuit connected with the car radio receiver. As soon as the detection circuit detects presence of an emergency vehicle near the car, it lowers the volume of the car radio receiver, thus allowing the car's driver to be alerted of the presence of the emergency vehicle.

14 Claims, 3 Drawing Sheets

SYSTEM AND METHOD FOR NOTIFICATION OF PRESENCE OF EMERGENCY VEHICLES

CROSS REFERENCE TO RELATED APPLICATIONS

The present application claims the benefit of U.S. Prov. App. 61/072,013 for an "Auto Siren Alert System" filed on Mar. 27, 2008 and incorporated herein by reference in its entirety.

FIELD

The present disclosure relates to the automotive field. More in particular, it relates to a system and method for notification of presence of emergency vehicles.

BACKGROUND

Emergency response vehicles (hereinafter emergency vehicles) usually have a tough time maneuvering through traffic. Many drivers cannot hear the emergency vehicles approaching because their radios are turned up very loudly. This can slow the pace of the emergency vehicle and make it late to its destination, which may result in bodily harm to a victim or late reaching of a crime scene (in case the emergency vehicle is a police car). Moreover, vehicles trying to get out of the way at the last minute may cause accidents by hitting other automobiles.

SUMMARY

According to a first aspect, a system for notification of presence of emergency vehicles is provided, comprising: an acoustic receiver adapted to be mounted on a car or vehicle; a detection circuit connected with the acoustic receiver and with a car or vehicle radio receiver, wherein the detection circuit is configured to detect presence of an emergency vehicle near the car or vehicle and lower the volume of the car or vehicle radio receiver upon detection of said presence through the acoustic receiver.

According to a second aspect, a system for notification of presence of emergency vehicles is provided, comprising: an antenna adapted to be mounted on a car or vehicle; a detection circuit connected with the antenna and with a car radio receiver, wherein the detection circuit is configured to detect presence of an emergency vehicle near the car and lower the volume of the car radio receiver upon detection of said presence through the antenna.

According to a third aspect, a method for notification of presence of emergency vehicles is provided, comprising: locating an acoustic receiver or an antenna on a car or vehicle; connecting a detection circuit with the acoustic receiver or the antenna, and with a car radio receiver; configuring the detection circuit to detect presence of an emergency vehicle near the car or vehicle; and lowering the volume of the car radio receiver upon detection of said presence through the acoustic receiver or antenna.

Further embodiments of the disclosure are shown in the specification, drawings and claims of the present application.

DISCLOSURE OF EXAMPLE EMBODIMENTS

Figure 1:
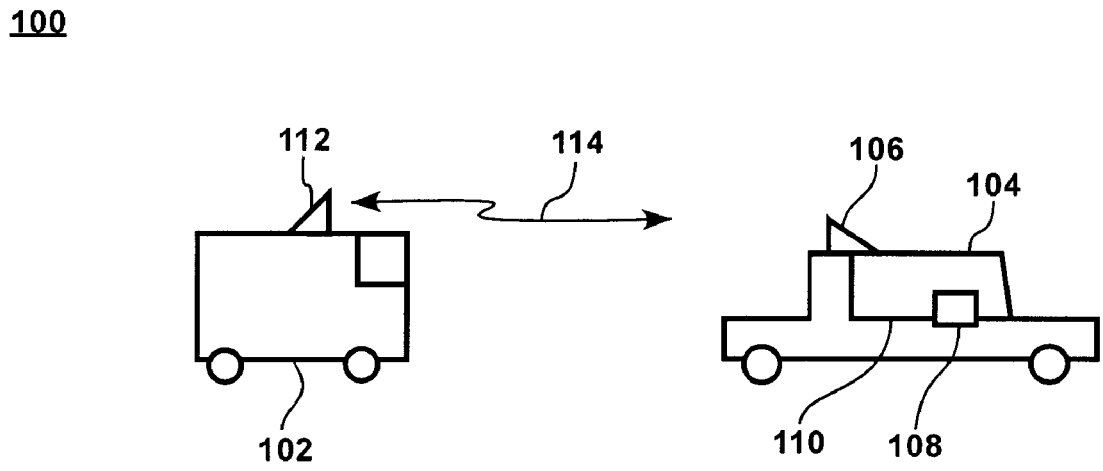
FIG. 1 shows a schematic representation of the system according to the present disclosure.

FIG. 1 shows a schematic representation 100 of an emergency vehicle 102 and a car 104. The car 104 is equipped with an acoustic receiver 106, a car radio receiver or stereo system 108 and a connection 110 connecting the acoustic receiver 106 to the car stereo system 108. The emergency vehicle 102 comprises an acoustic transmitter 112 (e.g., a horn) sending an acoustic signal 114.

The receiver 106, located, for example, on the roof of car 104, will receive the acoustic signal 114, which will be processed by circuitry inside the car 104, in order to detect whether signal 114 is an emergency vehicle signal. A possible detection circuitry is described in FIG. 2.

Figure 2:
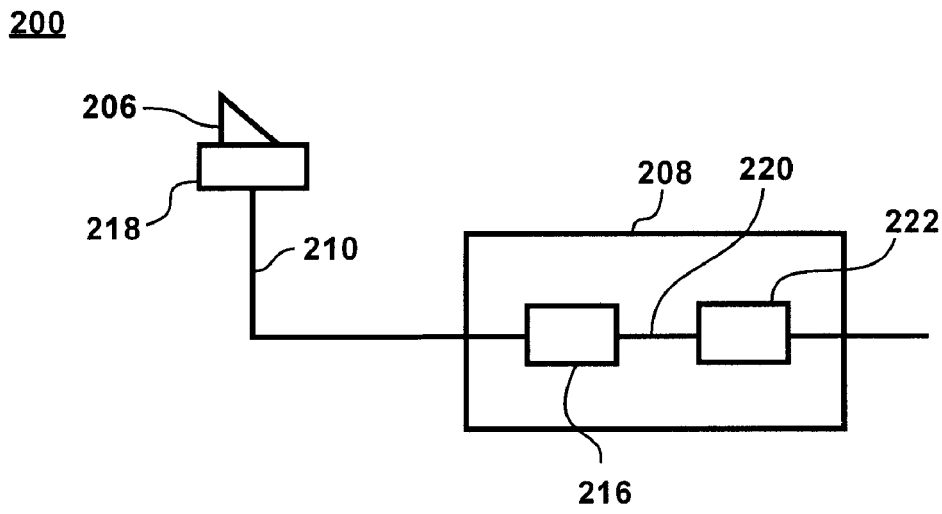
FIG. 2 shows in additional detail the arrangement provided on a driver's car.

In particular, FIG. 2 shows in additional detail the arrangement provided on a user's car. In particular, the car stereo 208 comprises a processor 216 connected both an input connection 210 carrying a signal 210 converted from acoustic to electric by a converter 218 associated with acoustic receiver 206. Signal 210 can be a digital signal and one of the purposes of processor 216 is that of determining if digital signal 210 is a signal indicative of the approaching of an emergency vehicle. If a determination is made, by processor 216, that signal 210 indicates presence of an emergency vehicle, then a signal 220 is sent to a volume control section 222 of the car stereo 208 to lower the volume of the car stereo 208.

In order to determine whether digital signal 210 is the signature of an emergency vehicle approaching the car, processor 216 could, for example, compare signal 210 with a pre-installed library of signals indicative of emergency vehicles and, in case of a match or a similarity above a certain threshold, activate output 220. Alternatively, processor 216 could extract one or more features of signal 210 (e.g., its frequency and amplitude) and evaluate whether such features correspond to those of an emergency vehicle. Such features could, for example, be compared with a set of features, stored in the processor, indicative of emergency vehicles. Frequency of the signal will allow recognition of the presence of an emergency vehicle, while the amplitude of the signal can be used to regulate the volume of the car stereo only if the value of the amplitude is above a predetermined threshold, meaning that the emergency vehicle is close. Reduction of the sound output of a radio receiver per se, e.g., matching the sound output of a radio receiver to the ambient noise level, is known from U.S. Pat. No. 4,247,955 to Weidemann, incorporated herein by reference in its entirety. Automatic volume adjustment for an automotive vehicle is known per se also from U.S. Pat. No. 4,359,713 to Tsunoda, also incorporated herein by reference in its entirety. Auto loudness circuits for performing loudness compensation automatically depending on a signal level are also known per se, see U.S. Pat. No. 7,016,509 to Bharitkar.

Figure 3:
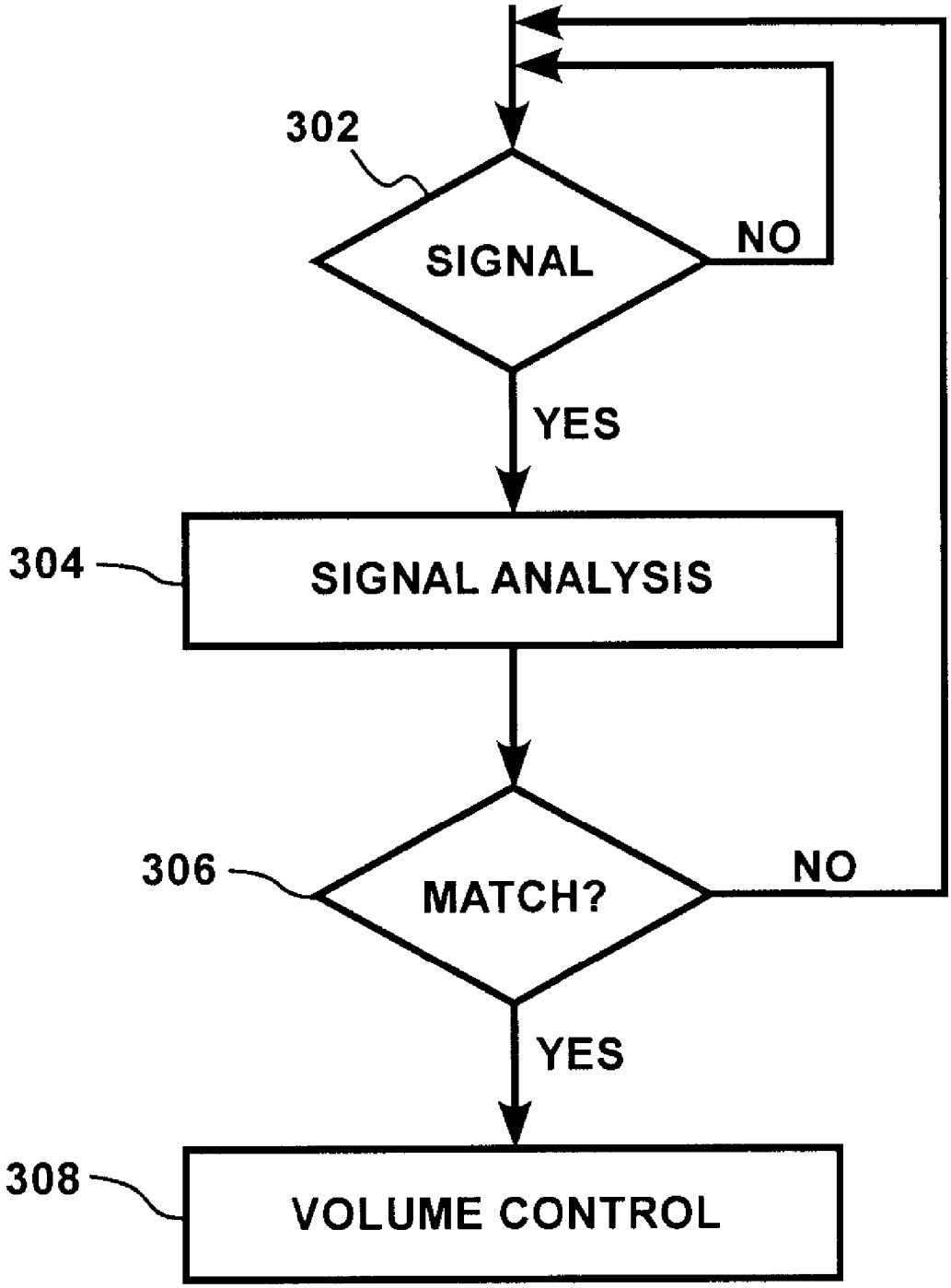
FIG. 3 shows a possible mode of operation of the processor of FIG. 2.

FIG. 3 shows a possible mode of operation of the processor 216 of FIG. 2. In step 302, processor 216 is in a waiting mode. As soon as a signal is received, signal analysis is performed in step 304. If there is a match (see evaluation step 306), volume control is performed in step 308. If, on the other hand, there is no match, the flow goes back to step 302, and the whole process is repeated.

The mode of operation of FIG. 3 is similar to the mode operation of cars where the volume of the stereo is adjusted based on the steering wheel and the car speed. In the present disclosure, however, volume adjustment occurs because of conditions external to the car and independent of the car's velocity.

Figure 4:
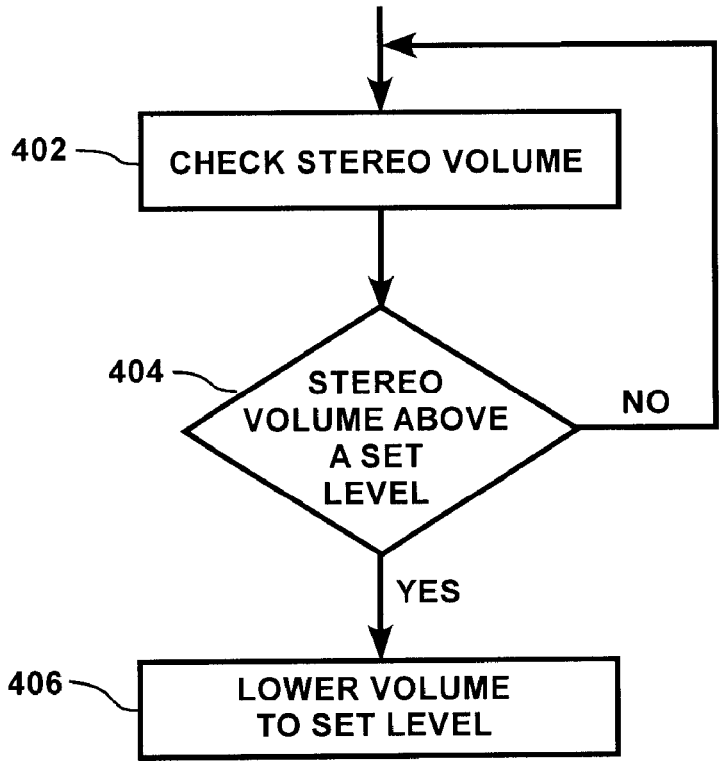
FIG. 4 shows a possible mode of operation of one of the steps of FIG. 3.

FIG. 4 shows a possible mode of operation of step 308 of FIG. 3. As shown in step 402, volume of the stereo is checked. In the evaluation step 404, it is evaluated whether the stereo volume is above a set level. If so, the flow proceeds to a step 406, where the volume is lowered. If not, the flow goes back to step 402.

Processor 216 has been shown inside the car stereo 208. However, the person skilled in the arts of processor design will understand that embodiments are also possible where the processor is outside the car stereo.

Once the emergency vehicle has left, two different approaches are possible. According to a first approach, readjustment of the volume is left directly to the driver, meaning that no readjustment will occur in absence of the driver's intervention. According to a second approach, the volume of the stereo checked, e.g, during step 402 of FIG. 4, can be stored and reinstated again on the stereo as soon as the emergency vehicle is distant again. Such condition could be satisfied, for example, if the emergency signal is recognized as such anymore by the processor 216 of FIG. 2 or if the amplitude of the emergency signal is below a certain level.

The circuitry and mode of operation described with reference to FIGS. 1-4 can be pre-installed in cars, so that they are sold to the driver upon purchase of the car. Alternative, embodiments are possible where an acoustic receiver+processor assembly is sold separately to users, in order to be installed on a vehicle.

Figure 5:
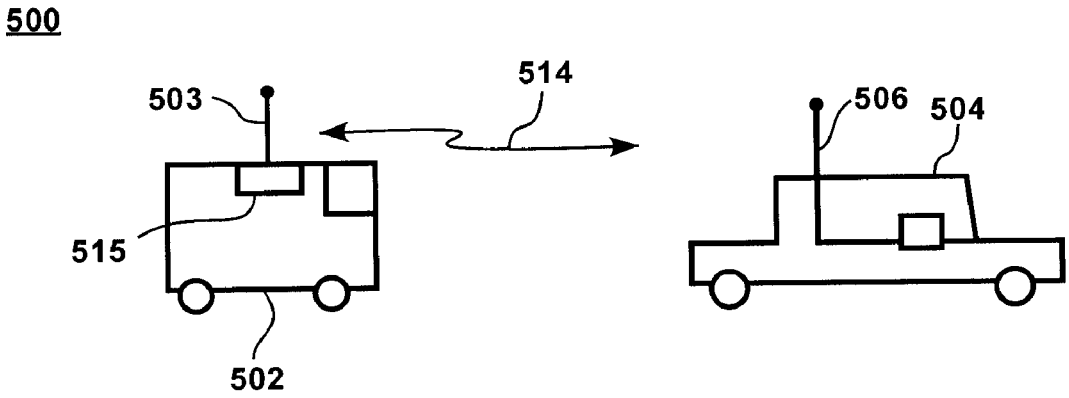
FIG. 5 shows a further embodiment of the present disclosure, where the signal transmitted by the emergency vehicle and received by the car is a radio signal.

According to a further embodiment of the present disclosure, the signal transmitted by the emergency vehicle and received by the car can be a radio signal. In this case, as also shown in FIG. 5, emergency vehicle 502 can be provided with a transmitting antenna 503, while car 504 can be provided with a receiving antenna 506. Signal 514 will be a radio signal. In such embodiment, emergency vehicle 502 will be equipped with a transmitter 515 to transmit a signal characteristic of that emergency vehicle or emergency vehicles in general. On the other hand, at the car's end, a comparison will be made between the received signal 514 and a library of signals indicative of emergency vehicles, similarly to what explained in the embodiment of FIG. 2.

In both embodiments, connection of the car stereo to the acoustic receiver or antenna is similar to the current connection between a car stereo and a radio signal receiving antenna. Moreover, in case the radio signal/antenna embodiment of FIG. 5 is used, antenna 506 could be the same antenna used for receiving music radio signals.

Therefore, according to some embodiments of the present disclosure, a system that works in conjunction with a driver's car stereo in order to be notified when an emergency vehicle is in close proximity has been disclosed. The system according to the disclosure can allow vehicles to move out of the way of the ambulance, police car, fire engine or other emergency vehicle, so that it may quickly get to its destination. Anyone can use this system in their vehicle for a convenient and compact way to be informed of an approaching emergency vehicle.

Lowering of the volume of the vehicle will allow the vehicle's driver to hear the siren of the emergency vehicle approaching and act accordingly. The system according to the present disclosure may come as an option on new vehicles, as a standard pre-installed component on new vehicles, or be produced as an aftermarket product. As the person skilled in the art of automotive design will understand, dimensions and materials used to manufacture the system according to the present disclosure may vary according to the circumstances.

The examples set forth above are provided to give those of ordinary skill in the art a complete disclosure and description of how to make and use the embodiments of the methods and systems for notification of presence of emergency vehicles, and are not intended to limit the scope of what the inventors regard as their disclosure. Modifications of the above-described modes for carrying out the disclosure may be used by persons of skill in the automotive design art, and are intended to be within the scope of the following claims. All patents and publications mentioned in the specification may be indicative of the levels of skill of those skilled in the art to which the disclosure pertains. All references cited in this disclosure are incorporated by reference to the same extent as if each reference had been incorporated by reference in its entirety individually.

The entire disclosure of each document cited (including patents, patent applications, journal articles, abstracts, laboratory manuals, books, or other disclosures) in the Background, Summary, and Description is hereby incorporated herein by reference.

It is to be understood that the disclosure is not limited to particular methods or systems, which can, of course, vary. It is also to be understood that the terminology used herein is for the purpose of describing particular embodiments only, and is not intended to be limiting. As used in this specification and the appended claims, the singular forms "a," "an," and "the" include plural referents unless the content clearly dictates otherwise. The term "plurality" includes two or more referents unless the content clearly dictates otherwise. Unless defined otherwise, all technical and scientific terms used herein have the same meaning as commonly understood by one of ordinary skill in the art to which the disclosure pertains.

A number of embodiments of the disclosure have been described. Nevertheless, it will be understood that various modifications may be made without departing from the spirit and scope of the present disclosure. Accordingly, other embodiments are within the scope of the following claims.

The invention claimed is:

1. A system for notification of presence of emergency vehicles, comprising:

an acoustic receiver adapted to be mounted on a car or vehicle;

a detection circuit connected with the acoustic receiver and with a car or vehicle radio receiver, wherein the detection circuit is configured to detect presence of an emergency vehicle near the car or vehicle and lower the volume of the car or vehicle radio receiver upon detection of said presence through the acoustic receiver, and wherein the detection circuit is further configured to reinstate the same volume as before approaching of the emergency vehicle as soon as the emergency vehicle has left.

2. The system of claim 1, wherein the detection circuit is a processor.

3. The system of claim 2, wherein the processor is located inside the car radio receiver.

4. The system of claim 1, further comprising a converter to convert an acoustic signal of the emergency vehicle received by the acoustic receiver to an electric signal.

5. The system of claim 4, wherein the electric signal is a digital signal indicative of the presence of the emergency vehicle.

6. The system of claim 1, wherein, upon detection of said presence, the detection circuit sends a signal to a volume control section of the car radio receiver.

7. The system of claim 1, wherein detection of the presence of the emergency vehicle occurs by comparing an electrical equivalent of the acoustic signal of the emergency vehicle with a pre-installed library of signals indicative of emergency vehicles.

8. The system of claim 1, wherein detection of the presence of the emergency vehicle occurs by extracting one or more features from an electrical equivalent of the acoustic signal of the emergency vehicle and evaluate whether the one or more features correspond to features of an emergency vehicle.

9. The system of claim 8, wherein the one or more features comprise frequency and/or amplitude.

10. The system of claim 9, wherein the detection circuit lowers the volume of the car radio receiver if the amplitude is above a set threshold.

11. The system of claim 1, wherein the system is a pre-installed system.

12. The system of claim 1, wherein the system is adapted to be installed on the car after car manufacture.

13. A car or vehicle comprising the system of claim 1.

14. A method for notification of presence of emergency vehicles, comprising:

locating an acoustic receiver on a car or vehicle;

connecting a detection circuit with the acoustic receiver, and with a car radio receiver;

configuring the detection circuit to detect presence of an emergency vehicle near the car or vehicle;

lowering the volume of the car radio receiver upon detection of said presence through the acoustic receiver; and reinstating the same volume as before approaching of the emergency vehicle as soon as the emergency vehicle has left.

* * * * *